US009121286B2

(12) United States Patent
Dolansky et al.

(10) Patent No.: US 9,121,286 B2
(45) Date of Patent: Sep. 1, 2015

(54) AIRFOIL HAVING TAPERED BUTTRESS

(75) Inventors: Gregory M. Dolansky, Higganum, CT (US); Benjamin T. Fisk, East Granby, CT (US); Tracy A. Propheter-Hinckley, Manchester, CT (US); Anita L. Tracy, Middletown, CT (US)

(73) Assignee: United Technologies Corporation, Hartford, CT (US)

( * ) Notice: Subject to any disclaimer, the term of this patent is extended or adjusted under 35 U.S.C. 154(b) by 866 days.

(21) Appl. No.: 13/454,369

(22) Filed: Apr. 24, 2012

(65) Prior Publication Data

US 2013/0280059 A1 Oct. 24, 2013

(51) Int. Cl.
*F01D 5/18* (2006.01)
*F01D 5/14* (2006.01)

(52) U.S. Cl.
CPC ..... *F01D 5/147* (2013.01)

(58) Field of Classification Search
CPC ..... F01D 5/147
USPC ..... 416/233; 29/889.72
See application file for complete search history.

(56) References Cited

U.S. PATENT DOCUMENTS

| | | | | |
|---|---|---|---|---|
| 2,343,918 A | | 5/1943 | McCoy | |
| 3,736,638 A | * | 6/1973 | Stone, Jr. | 29/889.72 |
| 4,815,939 A | | 3/1989 | Doble | |
| 5,038,014 A | | 8/1991 | Pratt et al. | |
| 5,165,860 A | | 11/1992 | Stoner et al. | |
| 5,240,376 A | * | 8/1993 | Velicki | 416/229 A |
| 5,443,367 A | | 8/1995 | Samit et al. | |
| 5,558,497 A | | 9/1996 | Kraft et al. | |
| 5,640,767 A | * | 6/1997 | Jackson et al. | 29/889.721 |
| 5,837,960 A | | 11/1998 | Lewis et al. | |
| 6,048,174 A | | 4/2000 | Samit et al. | |
| 6,391,251 B1 | | 5/2002 | Keicher et al. | |
| 6,669,447 B2 | | 12/2003 | Norris et al. | |
| 7,029,232 B2 | | 4/2006 | Tuffs et al. | |
| 7,112,044 B2 | | 9/2006 | Whitehead et al. | |
| 7,121,800 B2 | | 10/2006 | Beattie | |
| 7,121,801 B2 | | 10/2006 | Surace et al. | |
| 7,125,225 B2 | | 10/2006 | Surace et al. | |
| 7,270,517 B2 | | 9/2007 | Garner | |

(Continued)

OTHER PUBLICATIONS

International Search Report and Written Opinion for International Application No. PCT/US2013/037498 completed on Jul. 24, 2013.

(Continued)

*Primary Examiner* — Ninh H Nguyen
(74) *Attorney, Agent, or Firm* — Carlson, Gaskey & Olds, P.C.

(57) ABSTRACT

An airfoil includes an airfoil body that defines a longitudinal axis. The airfoil body includes a leading edge and a trailing edge and a first side wall and a second side wall that is spaced apart from the first sidewall. The first side wall and the second side wall join the leading edge and the trailing edge and at least partially define a cavity in the airfoil body. At least one of the first side wall and the second side wall includes at least one longitudinally elongated buttress that tapers longitudinally. The at least one longitudinally elongated buttress defines an increased thickness of, respectively, the first side wall or the second sidewall. The at least one longitudinally elongated buttress projects partially across the cavity toward the other of the first side wall or the second sidewall.

22 Claims, 4 Drawing Sheets

(56) References Cited

U.S. PATENT DOCUMENTS

| | | | | |
|---|---|---|---|---|
| 7,478,994 | B2 | 1/2009 | Cunha et al. | |
| 7,857,588 | B2 | 12/2010 | Propheter-Hinckley et al. | |
| 8,297,925 | B2 * | 10/2012 | Barrett | 416/92 |
| 8,807,925 | B2 * | 8/2014 | McKaveney et al. | 415/119 |
| 2008/0290215 | A1 | 11/2008 | Udall et al. | |
| 2009/0010765 | A1 | 1/2009 | Propheter-Hinckley et al. | |
| 2009/0060718 | A1 * | 3/2009 | Goldfinch et al. | 415/119 |
| 2009/0258168 | A1 | 10/2009 | Barcock | |
| 2011/0048664 | A1 | 3/2011 | Kush et al. | |

OTHER PUBLICATIONS

International Preliminary Report on Patentability for PCT Application No. PCT/US2013/037498, mailed Nov. 6, 2014.

* cited by examiner

AIRFOIL HAVING TAPERED BUTTRESS

BACKGROUND

This disclosure relates to an airfoil, such as an airfoil for a gas turbine engine.

Turbine, fan and compressor airfoil structures are typically manufactured using die casting techniques. For example, the airfoil is cast within a mold that defines an exterior airfoil surface. A core structure may be used within the mold to form impingement holes, cooling passages, ribs or other structures in the airfoil. The die casting technique inherently limits the geometry, size, wall thickness and location of these structures. Thus, the design of a traditional airfoil is limited to structures that can be manufactured using the die casting technique, which in turn may limit the performance of the airfoil.

SUMMARY

An airfoil according to an exemplary aspect of the present disclosure includes an airfoil body defining a longitudinal axis. The airfoil body includes a leading edge and a trailing edge and a first side wall and a second side wall that is spaced apart from the first side wall. The first side wall and the second side wall join the leading edge and the trailing edge and at least partially define a cavity in the airfoil body. At least one of the first side wall and the second side wall includes at least one longitudinally elongated buttress that tapers longitudinally. The at least one longitudinally elongated buttress defines an increased thickness of, respectively, the first side wall or the second side wall. The at least one longitudinally elongated buttress projects partially across the cavity toward the other of the first side wall or the second side wall.

In a further non-limiting embodiment of the above example, the at least one longitudinally elongated buttress includes a plurality of first longitudinally elongated buttresses on the first side wall and a plurality of second longitudinally elongated buttresses on the second side wall.

In a further non-limiting embodiment of any of the foregoing examples, the first plurality of longitudinally elongated buttresses are laterally offset from the second plurality of longitudinally elongated buttresses with respect to the longitudinal axis.

In a further non-limiting embodiment of any of the foregoing examples, the at least one longitudinally elongated buttress extends a full longitudinal length of the cavity.

In a further non-limiting embodiment of any of the foregoing examples, the at least one longitudinally elongated buttress includes a plurality of longitudinally elongated buttresses that are laterally spaced apart from each other with respect to the longitudinal axis.

In a further non-limiting embodiment of any of the foregoing examples, the airfoil body includes a base and a tip end, and the at least one longitudinally elongated buttress tapers longitudinally from the base to the tip end.

In a further non-limiting embodiment of any of the foregoing examples, the at least one longitudinally elongated buttress tapers in a direction perpendicular to the longitudinal axis.

In a further non-limiting embodiment of any of the foregoing examples, one of the first side wall and the second side wall that includes at least one longitudinally elongated buttress includes a wall through-thickness, exclusive of the at least one longitudinally elongated buttress, of 0.010 inches/254 micrometers to 0.060 inches/1524 micrometers.

In a further non-limiting embodiment of any of the foregoing examples, the at least one longitudinally elongated buttress includes a first longitudinally elongated buttress and a second longitudinally elongated buttress laterally spaced apart from the first longitudinally elongated buttress on the same one of the first side wall or the second side wall. The first side wall or the second side wall that has the first longitudinally elongated buttress and the second longitudinally elongated buttress further includes at least one cross-rib extending from the first longitudinally elongated buttress to the second longitudinally elongated buttress. The at least one cross-rib projects partially across the cavity toward the other of the first side wall or the second side wall.

In a further non-limiting embodiment of any of the foregoing examples, the at least one cross-rib includes a plurality of cross-ribs.

In a further non-limiting embodiment of any of the foregoing examples, the at least one cross-rib includes intersecting ribs.

A further non-limiting embodiment of any of the foregoing examples includes at least one support arm projecting from the at least one longitudinally elongated buttress and connecting to the other of the first side wall or the second side wall.

In a further non-limiting embodiment of any of the foregoing examples, the at least one longitudinally elongated buttress includes a first buttress on the first side wall and a second buttress on the second side wall, and further includes at least one support arm projecting from the first buttress and connecting to the second buttress.

A turbine engine according to an exemplary aspect of the present disclosure includes, optionally a fan, a compressor section, a combustor in fluid communication with the compressor section, and a turbine section in fluid communication with the combustor. The turbine section is coupled to drive the compressor section and the fan. At least one of the fan, the compressor section and the turbine section includes an airfoil having an airfoil body defines a longitudinal axis. The airfoil body includes a leading edge and a trailing edge and a first side wall and a second side wall that is spaced apart from the first side wall. The first side wall and the second side wall join the leading edge and the trailing edge and at least partially define a cavity in the airfoil body, and at least one of the first side wall and the second side wall includes a longitudinally elongated buttress that tapers longitudinally. The longitudinally elongated buttress defines an increased thickness of, respectively, the first side wall or the second side wall. The longitudinally elongated buttress projects partially across the cavity toward the other of the first side wall or the second side wall.

In a further non-limiting embodiment of any of the foregoing examples, the at least one longitudinally elongated buttress includes a plurality of first longitudinally elongated buttresses on the first side wall and a plurality of second longitudinally elongated buttresses on the second side wall.

In a further non-limiting embodiment of any of the foregoing examples, the first plurality of longitudinally elongated buttresses are laterally offset from the second plurality of longitudinally elongated buttresses with respect to the longitudinal axis.

In a further non-limiting embodiment of any of the foregoing examples, the at least one longitudinally elongated buttress extends a full longitudinal length of the cavity.

In a further non-limiting embodiment of any of the foregoing examples, one of the first side wall and the second side wall that includes at least one longitudinally elongated buttress includes a wall through-thickness, exclusive of the at least one longitudinally elongated buttress, of 0.010 inches/254 micrometers to 0.060 inches/1524 micrometers.

In a further non-limiting embodiment of any of the foregoing examples, the at least one longitudinally elongated buttress includes a first longitudinally elongated buttress and a second longitudinally elongated buttress laterally spaced apart from the first longitudinally elongated buttress on the same one of the first side wall or the second side wall, and the first side wall or the second side wall that has the first longitudinally elongated buttress and the second longitudinally elongated buttress further includes at least one cross-rib extending from the first longitudinally elongated buttress to the second longitudinally elongated buttress. The at least one cross-rib projects partially across the cavity toward the other of the first side wall or the second side wall.

A method for processing a blade according to an exemplary aspect of the present disclosure includes depositing multiple layers of a powdered metal onto one another, joining the layers to one another with reference to data relating to a particular cross-section of a blade, and producing the blade with an airfoil body defining a longitudinal axis. The airfoil body includes a leading edge and a trailing edge and a first side wall and a second side wall that is spaced apart from the first side wall. The first side wall and the second side wall join the leading edge and the trailing edge and at least partially define a cavity in the airfoil body. At least one of the first side wall and the second side wall include a longitudinally elongated buttress that tapers longitudinally. The longitudinally elongated buttress defines an increased thickness of, respectively, the first side wall or the second side wall, the longitudinally elongated buttress projecting partially across the cavity toward the other of the first side wall or the second side wall.

An airfoil according to an exemplary aspect of the present disclosure includes an airfoil body defining a longitudinal axis. The body includes a leading edge and a trailing edge and a first side wall and a second side wall that is spaced apart from the first side wall. The first side wall and the second side wall join the leading edge and the trailing edge and at least partially defining a cavity in the body. At least one of the first side wall and the second side wall includes at least one rib defining an increased thickness of, respectively, the first side wall or the second side wall. At least one rib projects partially across the cavity toward the other of the first side wall or the second side wall. At least one rib includes a flange.

In a further non-limiting embodiment of any of the foregoing examples, the at least one rib has an I-beam cross-section.

In a further non-limiting embodiment of any of the foregoing examples, the at least one rib has a T-beam cross-section.

In a further non-limiting embodiment of any of the foregoing examples, the at least one rib extends from at least one longitudinally elongated buttress that tapers longitudinally.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION OF THE PREFERRED EMBODIMENT

Figure 1:
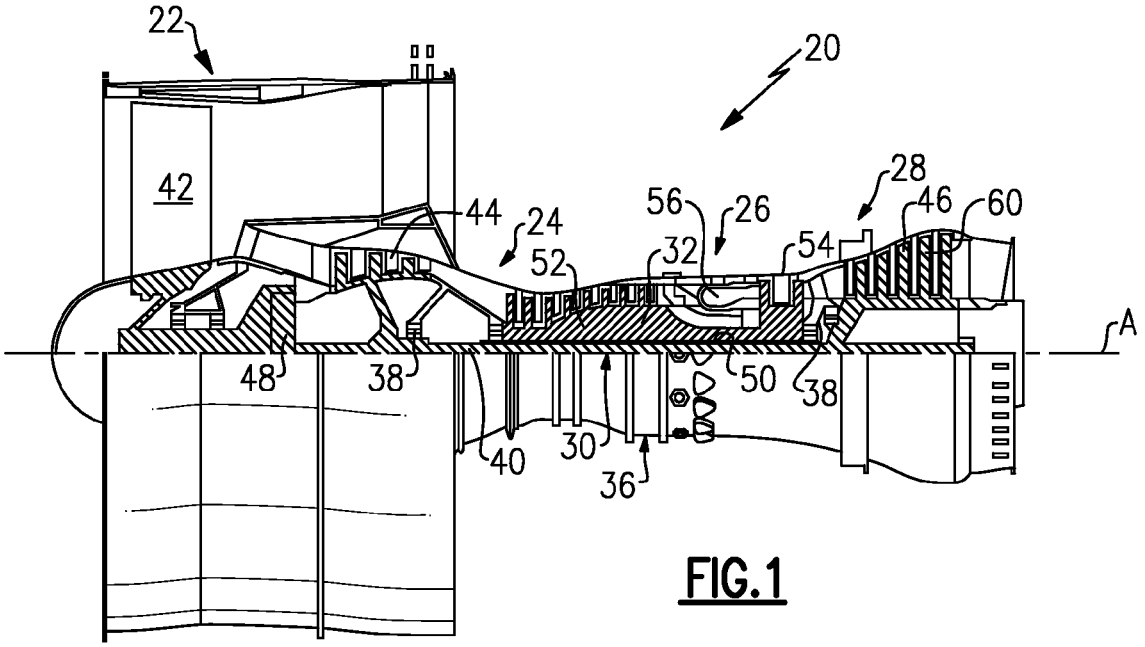
FIG. 1 shows an example gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flowpath while the compressor section 24 drives air along a core flowpath for compression and communication into the combustor section 26 then expansion through the turbine section 28. Although depicted as a turbofan gas turbine engine in the disclosed non-limiting embodiment, it should be understood that the concepts described herein are not limited to use with turbofans as the teachings may be applied to other types of turbine engines including three-spool architectures.

The engine 20 generally includes a first spool 30 and a second spool 32 mounted for rotation about an engine central axis A relative to an engine static structure 36 via several bearing systems 38. It should be understood that various bearing systems 38 at various locations may alternatively or additionally be provided.

The first spool 30 generally includes a first shaft 40 that interconnects a fan 42, a first compressor 44 and a first turbine 46. The first shaft 40 may be connected to the fan 42 through a gear assembly of a fan drive gear system 48 to drive the fan 42 at a lower speed than the first spool 30. The second spool 32 includes a second shaft 50 that interconnects a second compressor 52 and second turbine 54. The first spool 30 runs at a relatively lower pressure than the second spool 32. It is to be understood that "low pressure" and "high pressure" or variations thereof as used herein are relative terms indicating that the high pressure is greater than the low pressure. An annular combustor 56 is arranged between the second compressor 52 and the second turbine 54. The first shaft 40 and the second shaft 50 are concentric and rotate via bearing systems 38 about the engine central axis A which is collinear with their longitudinal axes.

The core airflow is compressed by the first compressor 44 then the second compressor 52, mixed and burned with fuel in the annular combustor 56, then expanded over the second turbine 54 and first turbine 46. The first turbine 46 and the second turbine 54 rotationally drive, respectively, the first spool 30 and the second spool 32 in response to the expansion.

Figure 2:
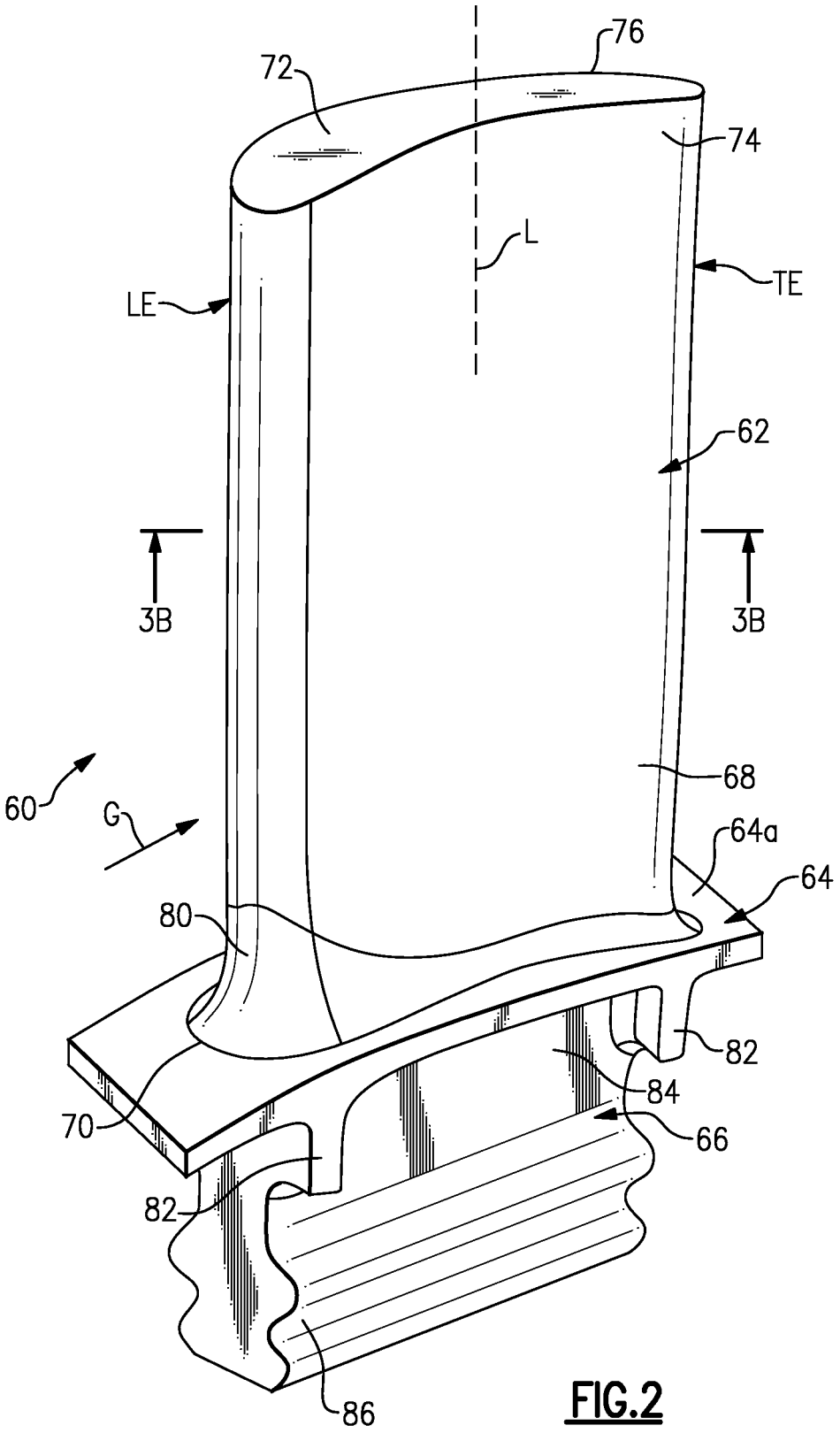
FIG. 2 shows a perspective view of an airfoil.

FIG. 2 illustrates an example airfoil 60. In this example, the airfoil 60 is a turbine blade of the turbine section 28. The airfoil 60 may be mounted on a turbine disk in a known manner with a plurality of like airfoils. Alternatively, it is to be understood that although the airfoil 60 is depicted as a turbine blade, the disclosure is not limited to turbine blades and the concepts disclosed herein are applicable to turbine vanes, compressor airfoils (blades or vanes) in the compressor section 24, fan airfoils in the fan section 22 or any other airfoil structures. Thus, some features that are particular to the illustrated turbine blade are to be considered optional.

The airfoil 60 includes an airfoil portion 62, a platform 64 and a root 66. The platform 64 and the root 66 are particular to the turbine blade and thus may differ in other airfoil structures or be excluded in other airfoil structures.

The airfoil 60 includes a body 68 that defines a longitudinal axis L between a base 70 at the platform 64 and a tip end 72. The longitudinal axis L in this example is perpendicular to the engine central axis A. The body 68 includes a leading edge (LE) and a trailing edge (TE) and a first side wall 74 (pressure side) and a second side wall 76 (suction side) that is spaced apart from the first side wall 74. The first side wall 74 and the second side wall 76 join the leading edge (LE) and the trailing edge (TE) and at least partially define a cavity 78 (FIG. 3) in the body 68.

The airfoil portion 62 connects to the platform 64 at a fillet 80. The platform 64 connects to the root 66 at buttresses 82. The root 66 generally includes a neck 84 and a serration portion 86 for securing the airfoil 60 in a disk.

It should be understood that relative positional terms such as "forward," "aft," "upper," "lower," "above," "below," "circumferential," "radial" and the like are with reference to the normal operational attitude and engine central axis A, unless otherwise indicated. Furthermore, with reference to the engine 20, the tip end 72 of the airfoil 60 is commonly referred to as the outer diameter of the airfoil 60 and the root 66 is commonly referred to as the inner diameter of the airfoil 60. The platform 64 includes an upper surface 64*a* that bounds an inner diameter of a gas path, generally shown as G, over the airfoil portion 62. Some airfoils may also include a platform at the tip end 72 that bounds an outer diameter of the gas path G.

Figure 3A:
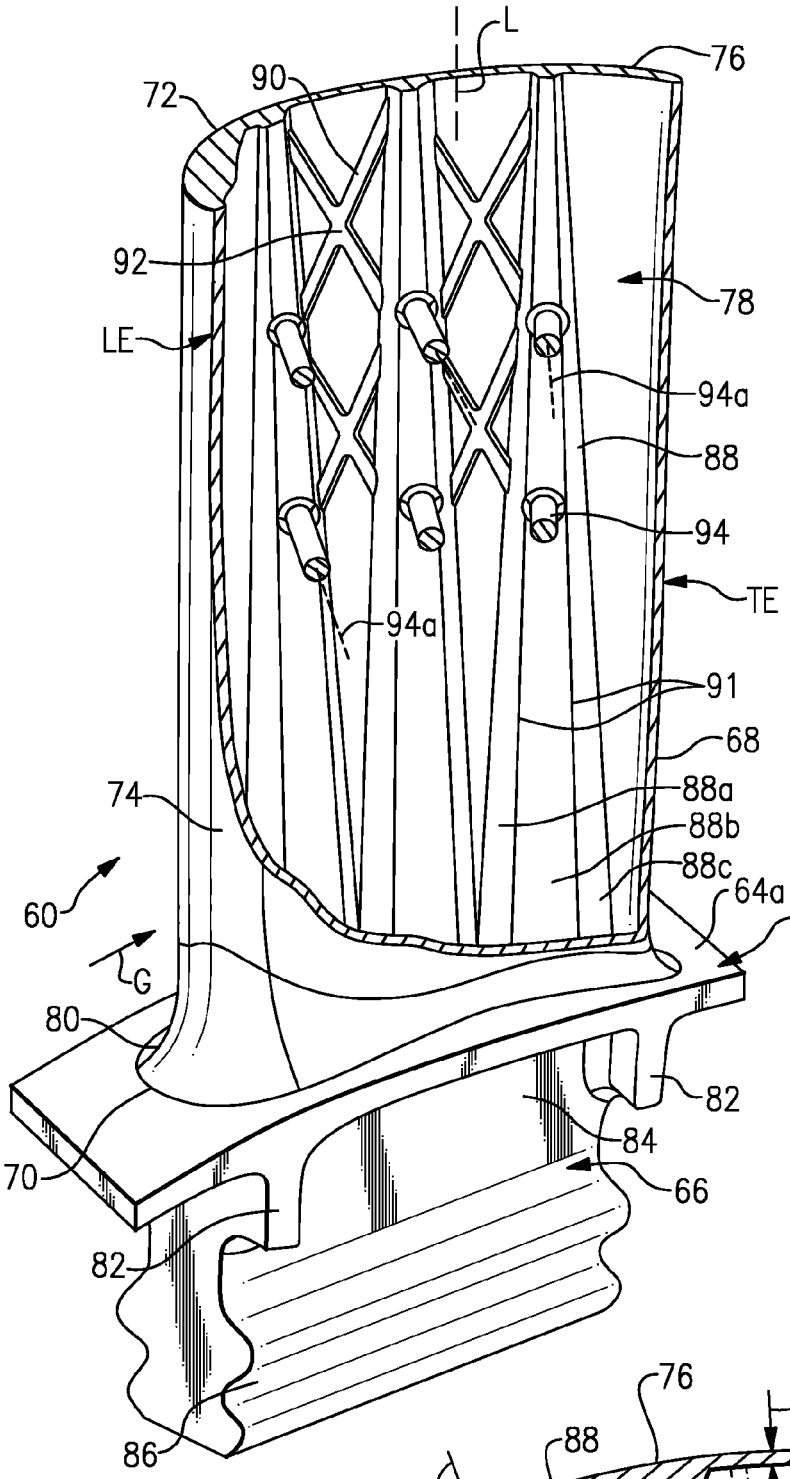
FIG. 3A shows the airfoil of FIG. 2 with a side wall cutaway to reveal an internal cavity.
Figure 3B:
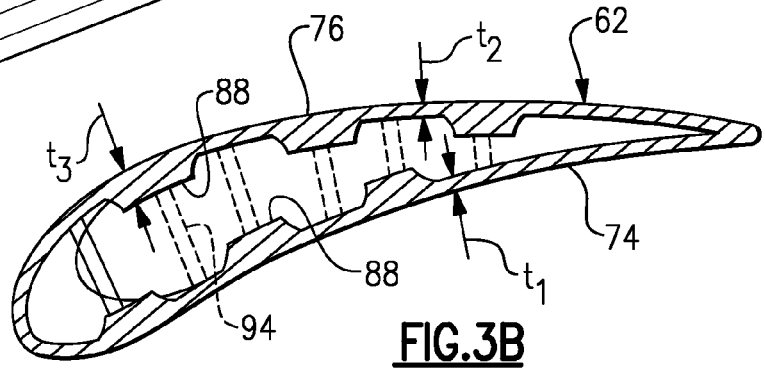
FIG. 3B shows a cross-section of the airfoil of FIG. 3A taken perpendicular to a longitudinal axis L.

FIG. 3A shows the airfoil 60 with a portion of the first side wall 74 cutaway to reveal the cavity 78 within the airfoil body 68 and FIG. 3B shows a cross-section perpendicular to the longitudinal axis L through the airfoil portion 62. In this example, at least one of the first side wall 74 and the second side wall 76 includes at least one longitudinally elongated buttress 88 that tapers longitudinally with regard to the longitudinal axis L. As shown, the at least one longitudinally elongated buttress 88 also optionally tapers in a direction perpendicular to the longitudinal axis L.

The airfoil 60 in this example includes a plurality of such longitudinally elongated buttresses 88, and each of the first side wall 74 and the second side wall 76 includes longitudinally elongated buttresses 88. It is to be understood, however, that the airfoil 60 may include fewer or more of the longitudinally elongated buttresses 88 and that a single one of the side walls 74 or 76 may include one or more longitudinally elongated buttresses 88. In this example, each of the longitudinally elongated buttresses 88 has facet surfaces 88*a*/88*b*/88*c* that meet at respective corners 91. The facet surfaces 88*a*/88*b*/88*c* and corners 91 form a strong, stiff structural feature that facilitates reinforcing the side walls 74 and 76 and carrying the pull load of the airfoil 60 as it rotates during operation.

In this example, each of the first side wall 74 and the second side wall 76 has a respective through-thickness represented, respectively, as $t_1$ and $t_2$. The longitudinally elongated buttress 88 defines an increased thickness $t_3$ of, respectively, the first side wall 74 or the second side wall 76. Each of the longitudinally elongated buttresses 88 projects partially across the cavity 78 toward the other of the first side wall 74 or the second side wall 76. Thus, the longitudinally elongated buttresses 88 do not connect, or bridge, the side walls 74 and 76.

In this example, the first side wall 74 includes a first plurality of longitudinally elongated buttresses 88 and the second side wall 76 includes a second plurality of the longitudinally elongated buttresses 88. Here, each of the side walls 74 and 76 include three longitudinally elongated buttresses 88. The longitudinally elongated buttresses 88 on the first side wall 74 are laterally spaced apart from each other with respect to the longitudinal axis L. Likewise, the longitudinally elongated buttresses 88 on the second side wall 76 are laterally spaced apart from each other. In this example, each of the longitudinally elongated buttresses 88 extends a full length of the cavity 78. It is to be understood, however, that the longitudinally elongated buttresses 88 may alternatively extend less than the full longitudinal length of the cavity 78.

Each of the longitudinally elongated buttresses 88 tapers longitudinally. In this example, the longitudinally elongated buttresses 88 taper from the base 70 toward the tip end 72 of the airfoil body 68.

In a further example, the thicknesses $t_1$ and $t_2$ of the side walls 74 and 76 is 0.010 inches/254 micrometers to 0.060 inches/1524 micrometers, or more specifically 0.015 inches/381 micrometers or less. That is, exclusive of the longitudinally elongated buttresses 88, the side walls 74 and 76 have a through-thickness in the prescribed range over at least a portion of the span of the airfoil body 68, such as the outer 25%. Such a wall thickness is not available using traditional die-casting techniques. Moreover, the thinner that the side walls 74 and 76 are made, the more the airfoil 60 may vibrate during operation of the engine 20. In that regard, the longitudinally elongated buttresses 88 reinforce the side walls 74 and 76, limit vibration and carry the pull load of the airfoil 60 as it rotates during operation.

Optionally, as also shown in FIG. 3A, at least one of the first side wall 74 and the second side wall 76 may include at least one cross-rib 90 that extends between neighboring longitudinally elongated buttresses 88. In the example shown, the second side wall 76 includes a plurality of such cross-ribs 90. The cross-ribs 90 intersect at a node 92 and serve to further reinforce the first side wall 74 or the second side wall 76. Similar to the longitudinally elongated buttresses 88, the cross-ribs 90 define an increased thickness of, respectively, the first side wall 74 or the second side wall 76. Also similar, the cross-ribs 90 extend only partially across the cavity 78 toward the other of the first side wall 74 or the second side wall 76.

Figure 3C:
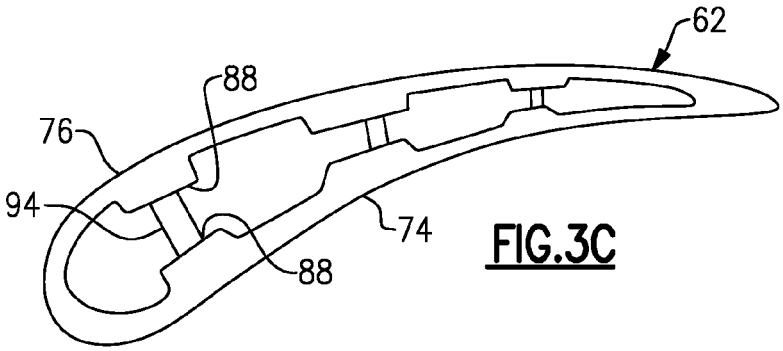
FIG. 3C shows a modified example of the airfoil of FIG. 3B.

Optionally, the airfoil 60 may also include at least one support arm 94 that projects from the longitudinally elongated buttress 88 and connects to the other of the first side wall 74 or the second side wall 76, or another of the buttresses 88 as shown in FIG. 3C. In this example, the airfoil 60 includes a plurality of such support arms 94 and the support arms 94 extend along respective central axes 94*a* that are perpendicular to, or alternatively inclined relative to, the longitudinal axis L. That is, all or some of the axes 94*a* can be perpendicular or all or some of the axes can be inclined. It is to be understood that the airfoil 60 may include fewer or additional support arms 94, depending upon the size of the airfoil 60 and the number of longitudinally elongated buttresses 88. The support arms 94 tie the side walls 74 and 76 together and further reinforce the airfoil 60. The support arms 94 may extend between opposing longitudinally elongated buttresses 88 on the first side wall 74 and the second side wall 76, or between one of the longitudinally elongated buttresses 88 and the opposing first side wall 74 or second side wall 76.

Figure 4:
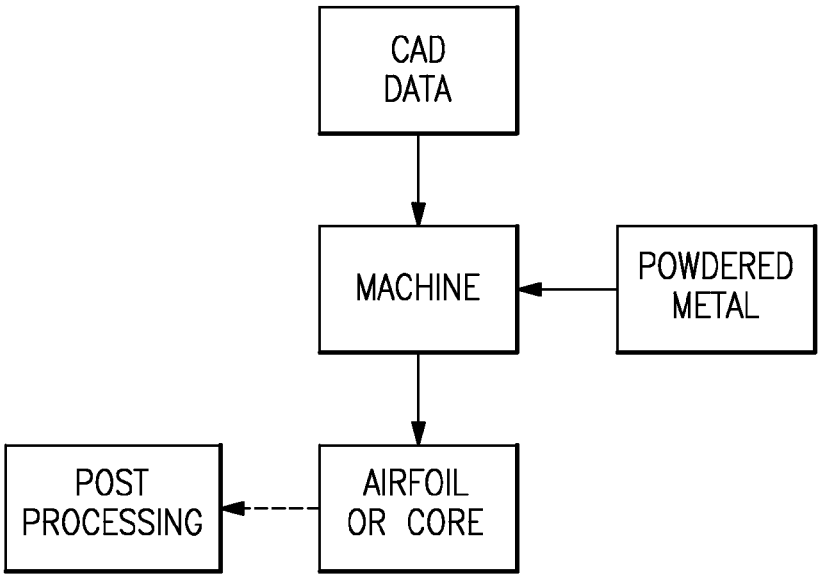
FIG. 4 shows a method of processing an airfoil.

The geometries disclosed herein may be difficult to form using conventional casting technologies. Thus, a method of processing an airfoil having the features disclosed herein includes an additive manufacturing process, as schematically illustrated in FIG. 4. Powdered metal suitable for aerospace airfoil applications is fed to a machine, which may provide a vacuum, for example. The machine deposits multiple layers of powdered metal onto one another. The layers are selectively joined to one another with reference to Computer-Aided Design data to form solid structures that relate to a particular cross-section of the airfoil. In one example, the powdered metal is selectively melted using a direct metal laser sintering process or an electron-beam melting process. Other layers or portions of layers corresponding to negative features, such as cavities or openings, are not joined and thus remain as a powdered metal. The unjoined powder metal may later be removed using blown air, for example. With the layers built upon one another and joined to one another cross-section by cross-section, an airfoil or portion thereof, such as for a repair, with any or all of the above-described geometries, may be produced. The airfoil may be post-processed to provide desired structural characteristics. For example, the airfoil may be heated to reconfigure the joined layers into a single crystalline structure.

Figure 5:
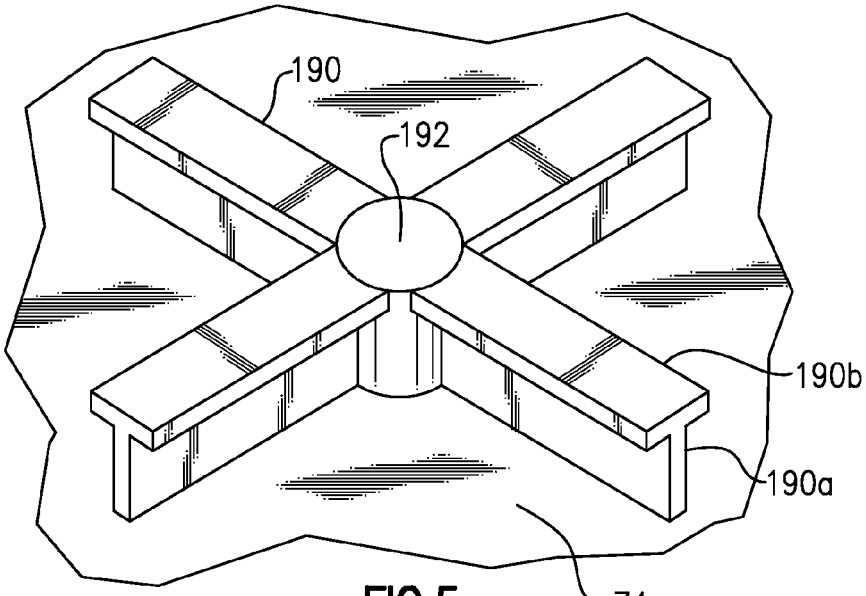
FIG. 5 shows an example of a cross-rib having a T-beam shape.

FIG. 5 shows an isolated view of modified cross-ribs 190 that can be used in the airfoil 60 in place of the cross-ribs 90. The cross-ribs 90 shown in FIG. 3A have a solid, rectangular cross-sectional geometry. In this example, however, the cross-ribs 190 have a T-beam cross-sectional geometry, for added stiffness and lighter weight. The T-beam shape of the cross-ribs 190 includes a first wall 190*a* that extends generally perpendicular to the respective first side wall 74 (or alternatively, the second side wall 76) and a flange wall 190*b* that, in this example, extends in a plane generally perpendicular to the plane of the first wall 190*a*.

Figure 6:
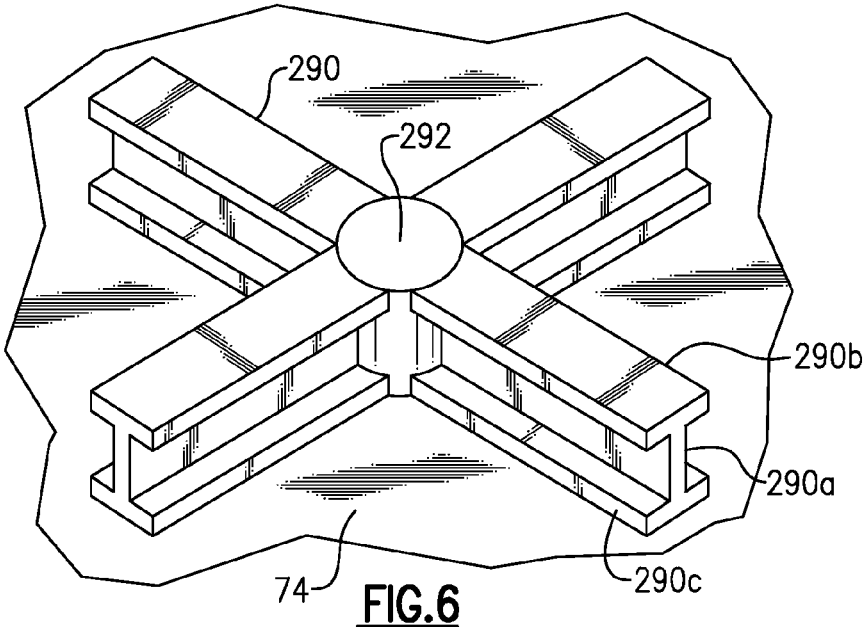
FIG. 6 shows another example of a cross-rib having an I-beam shape.

FIG. 6 illustrates another modified cross-rib 290 that can be used in the airfoil 60 in place of the cross-ribs 90. In this example, the cross-rib 290 has an I-beam cross-sectional geometry, for added stiffness. The I-beam shape of the cross-ribs 290 has a first wall 290*a* that extends generally perpendicular to the first side wall 74 (or alternatively, the second side wall 76) and a first flange wall 290*b* that extends in a plane that is generally perpendicular to the first wall 290*a*. Another flange wall 290*c* also extends in a plane that is generally perpendicular to the first wall 290*a*. The cross-ribs 190 and 290 may be formed using the additive manufacturing method as described above.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. An airfoil comprising:

an airfoil body defining a longitudinal axis, the airfoil body including a leading edge and a trailing edge and a first side wall and a second side wall that is spaced apart from the first side wall, the first side wall and the second side wall joining the leading edge and the trailing edge and at least partially defining a cavity in the airfoil body, and at least one of the first side wall and the second side wall including at least one longitudinally elongated buttress that tapers longitudinally, the at least one longitudinally elongated buttress defining an increased thickness of, respectively, the first side wall or the second side wall, the at least one longitudinally elongated buttress projecting partially across the cavity toward the other of the first side wall or the second side wall, wherein the at least one longitudinally elongated buttress includes a first buttress on the first side wall and a second buttress on the second side wall, and further including at least one support arm projecting from the first buttress and connecting to the second buttress.

2. The airfoil as recited in claim 1, wherein the at least one longitudinally elongated buttress includes a plurality of first longitudinally elongated buttresses on the first side wall and a plurality of second longitudinally elongated buttresses on the second side wall.

3. The airfoil as recited in claim 2, wherein the first plurality of longitudinally elongated buttresses are laterally offset from the second plurality of longitudinally elongated buttresses with respect to the longitudinal axis.

4. The airfoil as recited in claim 1, wherein the at least one longitudinally elongated buttress extends a full longitudinal length of the cavity.

5. The airfoil as recited in claim 1, wherein the at least one longitudinally elongated buttress includes a plurality of longitudinally elongated buttresses that are laterally spaced apart from each other with respect to the longitudinal axis.

6. The airfoil as recited in claim 1, wherein the airfoil body includes a base and a tip end, and the at least one longitudinally elongated buttress tapers longitudinally from the base to the tip end.

7. The airfoil as recited in claim 1, wherein the at least one longitudinally elongated buttress tapers in a direction perpendicular to the longitudinal axis.

8. The airfoil as recited in claim 1, wherein the one of the first side wall and the second side wall that includes the at least one longitudinally elongated buttress includes a wall through-thickness, exclusive of the at least one longitudinally elongated buttress, of 0.010 inches/254 micrometers to 0.060 inches/1524 micrometers.

9. The airfoil as recited in claim 1, wherein the at least one longitudinally elongated buttress includes a first longitudinally elongated buttress and a second longitudinally elongated buttress laterally spaced apart from the first longitudinally elongated buttress on the same one of the first side wall or the second side wall, and the first side wall or the second side wall that has the first longitudinally elongated buttress and the second longitudinally elongated buttress further includes at least one cross-rib extending from the first longitudinally elongated buttress to the second longitudinally elongated buttress, the at least one cross-rib projecting partially across the cavity toward the other of the first side wall or the second side wall.

10. The airfoil as recited in claim 9, wherein the at least one cross-rib includes a plurality of cross-ribs.

11. An airfoil comprising an airfoil body defining a longitudinal axis, the airfoil body including a leading edge and a trailing edge and a first side wall and a second side wall that is spaced apart from the first side wall, the first side wall and the second side wall joining the leading edge and the trailing edge and at least partially defining a cavity in the airfoil body, and at least one of the first side wall and the second side wall including at least one longitudinally elongated buttress that tapers longitudinally, the at least one longitudinally elongated buttress defining an increased thickness of, respectively, the first side wall or the second side wall, the at least one longitudinally elongated buttress projecting partially across the cavity toward the other of the first side wall or the second side wall, wherein the at least one longitudinally elongated buttress includes a first longitudinally elongated buttress and a second longitudinally elongated buttress laterally spaced apart from the first longitudinally elongated buttress on the same one of the first side wall or the second side wall, and the first side wall or the second side wall that has the first longitudinally elongated buttress and the second longitudinally elongated buttress further includes at least one cross-rib extending from the first longitudinally elongated buttress to the second longitudinally elongated buttress, the at least one cross-rib projecting partially across the cavity toward the other of the first side wall or the second side wall, wherein the at least one cross-rib includes intersecting ribs.

12. An airfoil comprising an airfoil body defining a longitudinal axis, the airfoil body including a leading edge and a trailing edge and a first side wall and a second side wall that is spaced apart from the first side wall, the first side wall and the second side wall joining the leading edge and the trailing edge and at least partially defining a cavity in the airfoil body, at least one of the first side wall and the second side wall including at least one longitudinally elongated buttress that tapers longitudinally, the at least one longitudinally elongated buttress defining an increased thickness of, respectively, the first side wall or the second side wall, the at least one longitudinally elongated buttress projecting partially across the cavity toward the other of the first side wall or the second side wall; and at least one support arm projecting from the at least one longitudinally elongated buttress and connecting to the other of the first side wall or the second side wall.

13. A turbine engine comprising:

a fan;

a compressor section;

a combustor in fluid communication with the compressor section; and a turbine section in fluid communication with the combustor, the turbine section being coupled to drive the compressor section and the fan, at least one of the fan, the compressor section and the turbine section including an airfoil having an airfoil body defining a longitudinal axis, the airfoil body including a leading edge and a trailing edge and a first side wall and a second side wall that is spaced apart from the first side wall, the first side wall and the second side wall joining the leading edge and the trailing edge and at least partially defining a cavity in the airfoil body, and at least one of the first side wall and the second side wall including a longitudinally elongated buttress that tapers longitudinally, the longitudinally elongated buttress defining an increased thickness of, respectively, the first side wall or the second side wall, the longitudinally elongated buttress projecting partially across the cavity toward the other of the first side wall or the second side wall, wherein the at least one longitudinally elongated buttress includes a first buttress on the first side wall and a second buttress on the second side wall; and at least one support arm projecting from the first buttress and connecting to the second buttress.

14. The turbine engine as recited in claim 13, wherein the at least one longitudinally elongated buttress includes a plurality of first longitudinally elongated buttresses on the first side wall and a plurality of second longitudinally elongated buttresses on the second side wall.

15. The turbine engine as recited in claim 13, wherein the first plurality of longitudinally elongated buttresses are laterally offset from the second plurality of longitudinally elongated buttresses with respect to the longitudinal axis.

16. The turbine engine as recited in claim 13, wherein the at least one longitudinally elongated buttress extends a full longitudinal length of the cavity.

17. The turbine engine as recited in claim 13, wherein the one of the first side wall and the second side wall that includes the at least one longitudinally elongated buttress includes a wall through-thickness, exclusive of the at least one longitudinally elongated buttress, of 0.010 inches/254 micrometers to 0.060 inches/1524 micrometers.

18. The turbine engine as recited in claim 13, further including at least one cross-rib extending from the first buttress to the second buttress, the at least one cross-rib projecting partially across the cavity toward the other of the first side wall or the second side wall.

19. A method for processing a blade, the method comprising:

depositing multiple layers of a powdered metal onto one another;

joining the layers to one another with reference to data relating to a particular cross-section of a blade; and producing the blade with an airfoil body defining a longitudinal axis, the airfoil body including a leading edge and a trailing edge and a first side wall and a second side wall that is spaced apart from the first side wall, the first side wall and the second side wall joining the leading edge and the trailing edge and at least partially defining a cavity in the airfoil body, and at least one of the first side wall and the second side wall including a longitudinally elongated buttress that tapers longitudinally, the longitudinally elongated buttress defining an increased thickness of, respectively, the first side wall or the second side wall, the longitudinally elongated buttress projecting partially across the cavity toward the other of the first side wall or the second side wall.

20. An airfoil comprising:

an airfoil body defining a longitudinal axis, the body including a leading edge and a trailing edge and a first side wall and a second side wall that is spaced apart from the first side wall, the first side wall and the second side wall joining the leading edge and the trailing edge and at least partially defining a cavity in the body, and at least one of the first side wall and the second side wall including at least one rib defining an increased thickness of, respectively, the first side wall or the second side wall, the at least one rib extending from at least one longitudinally elongated buttress that tapers longitudinally, the at least one rib projecting partially across the cavity toward the other of the first side wall or the second side wall, the at least one rib including a flange.

21. The airfoil as recited in claim 20, wherein the at least one rib has a T-beam cross-section.

22. An airfoil comprising an airfoil body defining a longitudinal axis, the body including a leading edge and a trailing edge and a first side wall and a second side wall that is spaced apart from the first side wall, the first side wall and the second side wall joining the leading edge and the trailing edge and at least partially defining a cavity in the body, and at least one of the first side wall and the second side wall including at least one rib defining an increased thickness of, respectively, the first side wall or the second side wall, the at least one rib projecting partially across the cavity toward the other of the first side wall or the second side wall, the at least one rib including a flange, wherein the at least one rib has an I-beam cross-section.

* * * * *